US007180494B2

(12) United States Patent
Ponzetta et al.

(10) Patent No.: US 7,180,494 B2
(45) Date of Patent: Feb. 20, 2007

(54) METHOD AND DEVICE FOR CONTROLLING A MULTIPLEXED DISPLAY SCREEN OPERATING IN REDUCED CONSUMPTION MODE

(75) Inventors: Antonio Martino Ponzetta, Gampelen (CH); Francisco Ramos, Neuchatel (CH); Sylvain Grosjean, Morteau (FR)

(73) Assignee: EM Microelectronic-Marin SA, Marin (CH)

( * ) Notice: Subject to any disclaimer, the term of this patent is extended or adjusted under 35 U.S.C. 154(b) by 315 days.

(21) Appl. No.: 10/239,413

(22) PCT Filed: Mar. 15, 2001

(86) PCT No.: PCT/CH01/00159

§ 371 (c)(1),
(2), (4) Date: Feb. 14, 2003

(87) PCT Pub. No.: WO01/75854

PCT Pub. Date: Oct. 11, 2001

(65) Prior Publication Data

US 2004/0090433 A1 May 13, 2004

(30) Foreign Application Priority Data

Apr. 4, 2000 (EP) ..... 00201217

(51) Int. Cl.
*G09G 3/36* (2006.01)

(52) U.S. Cl. ..... 345/95; 345/94; 345/96; 345/208; 345/209; 345/210

(58) Field of Classification Search ..... 345/204, 345/94–96, 208–210
See application file for complete search history.

(56) References Cited

U.S. PATENT DOCUMENTS

| | | | | |
|---|---|---|---|---|
| 3,976,362 | A | 8/1976 | Kawakami | |
| 4,910,496 | A * | 3/1990 | Hatanaka et al. | 340/458 |
| 5,218,352 | A | 6/1993 | Endoh et al. | |
| 5,805,121 | A * | 9/1998 | Burgan et al. | 345/50 |
| 5,859,625 | A * | 1/1999 | Hartung et al. | 345/95 |
| 6,137,466 | A * | 10/2000 | Moughanni et al. | 345/99 |

FOREIGN PATENT DOCUMENTS

EP 811 866 A1 12/1996

* cited by examiner

*Primary Examiner*—Richard Hjerpe
*Assistant Examiner*—Leonid Shapiro
(74) *Attorney, Agent, or Firm*—Sughrue Mion, PLLC

(57) ABSTRACT

The present invention concerns a method and a device (30) for controlling a multiplexed display comprising a plurality of pixels arranged in lines and in columns and coupled to line electrodes and column electrodes, each of the pixels being selectively activated or deactivated by a determined combination of a line signal (BP1 to BP24) and of a column signal (FP1 to FP5) applied respectively across the corresponding line and column electrodes.

According to the present invention, the display is switched between a first so-called normal operating mode, wherein all the display lines are activated, and at least a second so-called standby operating mode, wherein so-called non-active lines of the display are deactivated by applying, across the corresponding line electrodes, so-called non-activation line signals. During the passage into standby operating mode, one acts on the line signals applied across the still active lines and across the column signals such that their multiplex rate is reduced in proportion to the number of nonactive lines.

11 Claims, 8 Drawing Sheets

Fig. 1
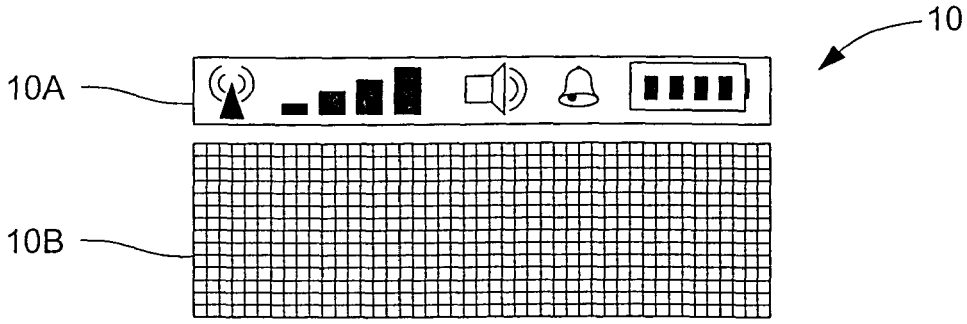
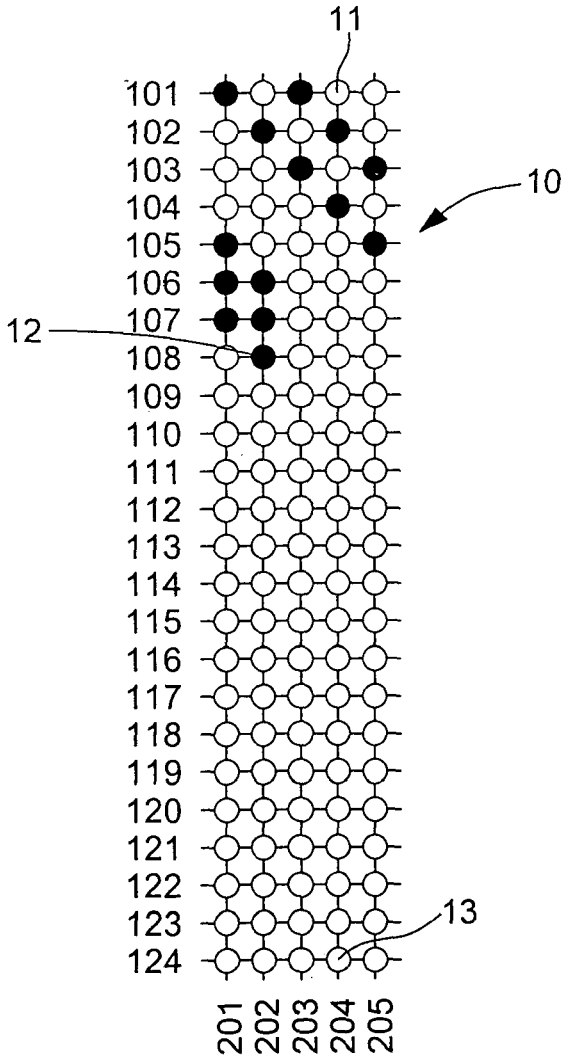
Fig. 2

METHOD AND DEVICE FOR CONTROLLING A MULTIPLEXED DISPLAY SCREEN OPERATING IN REDUCED CONSUMPTION MODE

BACKGROUND OF THE INVENTION

The present invention relates generally to a method and a device for controlling a multiplexed device. "Multiplexed display device" or more simply "multiplexed display" means, within the scope of the present description, a display device with multiple lines, i.e. a display device having a number of display lines greater than one, and which is controlled by multiplexing. "Multiplexing" means here that the display control signals are multiplexed over time. One will also speak of "dynamic" display.

The present invention applies to any type of multiplexed display, whatever its size. In particular, the present invention advantageously applies to multiplexed liquid crystal displays (LCD).

With reference to FIG. 1, there is illustrated a conventional dynamic display device 10. The display illustrated typically includes a first display section 10A and a second display section 10B. This display 10 is of a conventional type found for example in cellular telephones. The first display section 10A is thus a display section including predefined symbols, for example symbols intended to indicate the reception level of a cellular telephone, the battery autonomy, the arrival of a call, the time, or any other information which is typically permanently displayed on the display when the apparatus is activated. The second display section 10B is typically a matrix type display section for displaying alphanumerical and/or graphic data such as the number of a caller, a short message, etc. The first and second display sections are typically physically interconnected so as to form only one composite display including a section of symbols and a matrix section for displaying alphanumerical messages.

The display illustrated in FIG. 1 thus typically has a set of segments or pixels arranged in lines and columns. In order to activate these segments and pixels, a plurality of line and column electrodes (not shown), are respectively coupled to lines and columns of the display. In the case of an LCD display, these line and column electrodes are for example disposed on opposite plates between which the liquid crystal layer is arranged. Voltages applied to the line and column electrodes combine to generate an electric field in a zone between the electrodes. This zone between the electrodes is called "pixel" or "segment" depending on the geometry of the zone. Thus, in the case of first display section 10A including the symbols, one will preferably speak of "segments", whereas in the case of second display section 10B, one will preferably speak of "pixels". Nonetheless, in both cases, the voltages applied to the line and column electrodes combine to selectively activate or deactivate pixels or segments of the display. By way of simplification, the term "pixel" will be used in the following description to indicate indiscriminately a pixel or segment of the display.

It will be understood that the terms "line" and "column" are used to indicate that the pixels are arranged in matrix form and are controlled by pairs of electrodes, each pixel being located at an intersection of a pair of line and column electrodes. In certain displays, these pairs of electrodes can however be called differently, for example by the terms "foreplane electrode" and "backplane electrode". Within the scope of the present description, the terms "line electrode" and "column electrode" designate any type of electrode arrangement, including arrangements wherein the electrodes are not arranged in a linear manner. It will also be understood that the terms "line" and "column" do not necessarily imply that a line extends horizontally and that a column extends vertically. The terms "line" and "column" can thus perfectly well be interchanged.

The dynamic displays that have just been briefly presented, such as Liquid Crystal Displays (LCD), are frequently used in numerous battery-powered products, such as calculators, personal digital assistant, portable phones, electronic timepieces, etc. One significant advantage of such display devices is their relatively low power consumption allowing the products incorporating them to operate for a long time by means of their battery or to operate with batteries of smaller dimensions.

The current tendency is to produce efficient devices of small dimensions whose power consumption is reduced as much as possible. One way of saving energy in a device incorporating a dynamic display such as an LCD would consist in entirely cutting off the power supply to the display pixels which are in standby mode or which are not otherwise being used. It has been realised however in practice that it is not possible to cut off the power supply to the pixels entirely. In practice, the pixels, in particular the pixels of an LCD type display typically have to be controlled by a alternating control signal of zero continuous component, even when the pixels are in the "off" state. If the control signal included a non-zero continuous component, this could result in residual polarisation of the display which would make the latter non-operational.

SUMMARY OF THE INVENTION

The control signals conventionally applied to the line and column electrodes take the form of a succession of alternate frames such that the mean resulting voltage at a pixel, taken over a period covering two successive frames, is zero. More specifically, from one frame to another, the signal is reversed or inverted with respect to the signal generated during the preceding frame. In the following description, a series of two successive frames is defined as a cycle, this cycle being thus divided into a first half-cycle corresponding to a first frame and a second half-cycle corresponding to a reversed frame with respect to the first.

According to this conventional control technique, the non-active pixels are typically kept in the "off" state by the application of voltages such that the resulting voltage across the non-active pixel has too low an amplitude to switch it to the "on" state. Each pixel of the display, whether it is in the "on" or "off" state thus typically sees abrupt and frequent switchings of voltage levels at its terminals, each of these switchings consuming energy.

U.S. Pat. No. 5,805,121 thus suggests a method for controlling an aforementioned dynamic display via which the number of switches at the pixels, in particular at the pixels in the "off" state, is substantially reduced. Although a substantial reduction in power consumption is achieved owing to the teaching of this document, there still exists a need to find more optimum solutions allowing the power consumption of such multiplexed displays to be reduced even more substantially.

It can be noted in particular that one drawback of the control method proposed in U.S. Pat. No. 5,805,121, considering the example shown in FIG. 5 of that document, lies in the fact that during three-quarters of a control cycle, the control signals applied to the line electrodes are all kept at non-activation voltage levels. This fraction of the cycle during which the signals are kept at non-activation levels is all the more significant the greater the number of display lines put in the non-active state (in the example of FIG. 5, this number is three non-active display lines out of four). It will thus be noted that the time dedicated to the control of the still active display lines is not optimised with respect to the total duration of the control cycle.

A general object of the present invention is thus to propose a control method for a multiplexed display that overcomes the drawbacks of the control techniques of the prior art and which answers, in particular, both a concern as to reducing power consumption and a concern as to optimising the control of such a multiplexed display.

This object is achieved, according to the present invention, owing to the control method whose features are stated in the claims.

Another object of the present invention is to propose a control device for a multiplexed display for implementing the aforementioned method.

This object is achieved, according to the present invention, owing to the control device whose features are stated in the claims.

Advantageous variants of the control method and device according to the present invention form the subject of the dependent claims.

One advantage of the technique proposed by the invention lies in the fact that the display control not only ensures a substantial reduction in power consumption, but also optimum control of the display. These two effects are assured by suitable control of the display multiplex rates as will be seen in ample detail hereinafter in the present description.

BRIEF DESCRIPTION OF THE DRAWINGS

Other features and advantages of the present invention will appear more clearly upon reading the following detailed description, made with reference to the annexed drawings, given by way of non-limiting examples in which:

FIG. 1, already presented, shows a conventional example of a multiplexed display device;

FIG. 2 shows an example of a multiplexed display device comprising twenty-four lines and five columns, used within the scope of a particular embodiment to illustrate the operating principle of the present invention;

DETAILED DESCRIPTION OF THE INVENTION

Figure 3A:
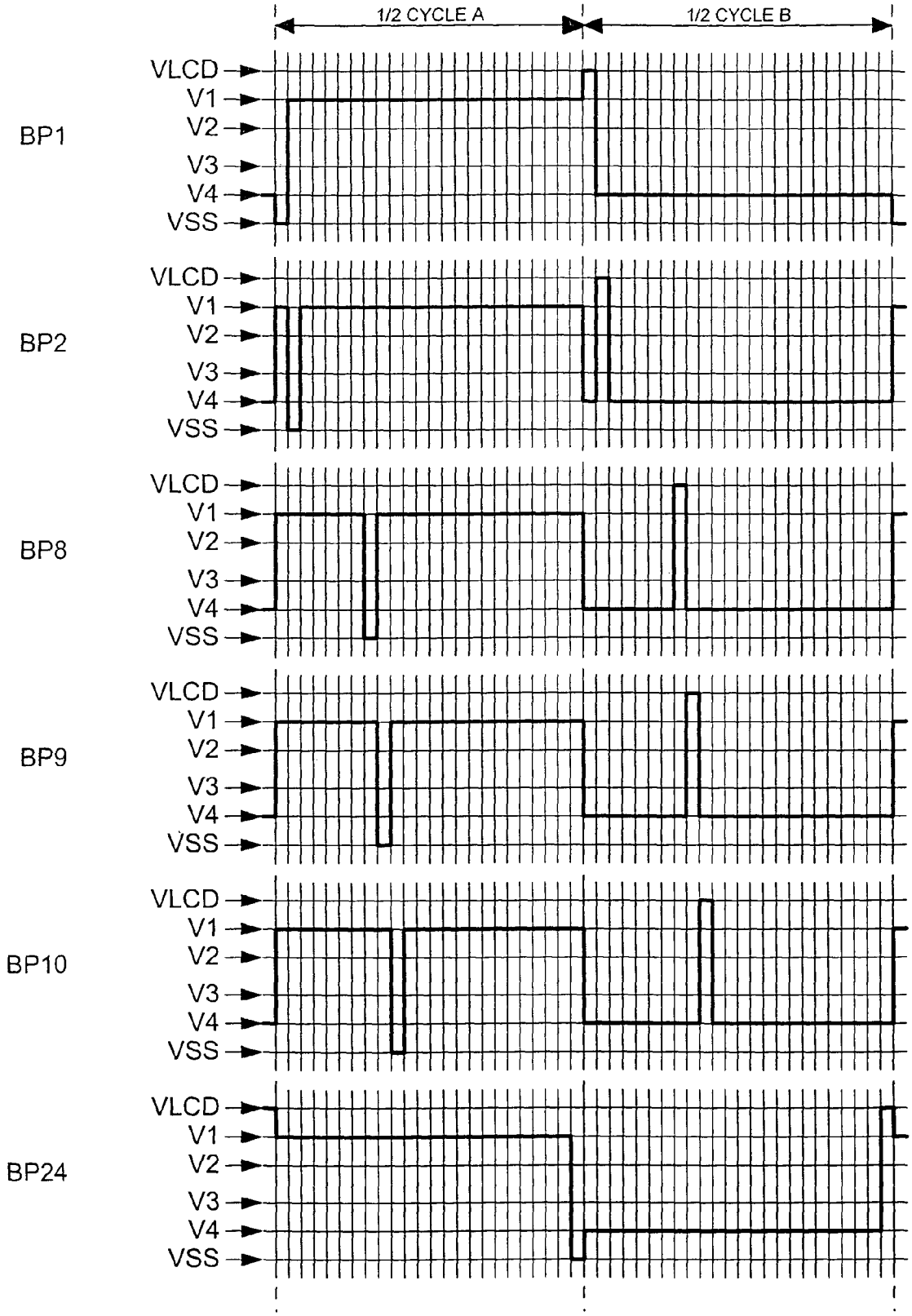
FIGS. 3A and 3B illustrate, in a first so-called normal operating mode in which the twenty-four lines of the display are active, examples of signals able to be applied respectively to the lines and columns of the display of FIG. 2 to selectively activate or deactivate pixels of said display.

The control method according to the present invention will be described first of all by means of FIG. 2 and FIGS. 3A to 3C and 4A to 4C. FIG. 2 shows by way of explanation, a non-limiting example of a multiplexed display, generally designated by the reference numeral 10, comprising a plurality of pixels arranged in twenty-four lines, designated 101 to 124 and in five columns, designated 201 to 205. As is schematised in FIG. 2, certain pixels, shown in black in the Figure, are in the ON state, i.e. a so-called active state. Other pixels, shown in white in the Figure, are in the OFF state, i.e. a non-active state. In the following description, we will be particularly interested in the pixels designated by the references 11, 12 and 13 chosen from among the set of display pixels to illustrate the control method according to the present invention. Pixel 11 is thus located at the intersection of line 101 and column 204, pixel 12 at the intersection of line 108 and column 202 and pixel 13 at the intersection of line 124 and column 204. It will be noted that pixel 12 is active whereas pixels 11 and 13 are inactive.

Symbol lines have not been shown in display 10 of FIG. 2. It will be understood nonetheless that first line 101 of the display can for example correspond to a line of symbols in accordance with the illustration of FIG. 1 for example. It will be recalled again here that the term "pixel" covers both a matrix type display pixel and a display segment formed of determined symbols.

The pixels are coupled to line electrodes and to column electrodes (not shown) to each of which a line signal, or respectively, a column signal is applied, the combination of which defines the state of activation of the pixel located at the intersection of the corresponding line and column.

The lines 101 to 124 of the display are sequentially activated by means of line signals applied to the corresponding line electrodes (not shown) of display 10 of FIG. 2. These line signals will be designated in the description hereinafter by the references BP1 to BP24, signal BP1 corresponding to the line signal applied to line electrode 101, signal BP2 to the line signal applied to line electrode 102 and so on as far as signal BP24 applied to line electrode 124.

FIG. 3A illustrates, in a first so-called normal operating mode of the display, the shape of the line signals applied to the line electrodes of the display. For the sake of simplification, in FIG. 3A, only line signals BP1, BP2, BP8 to BP10 and BP24 respectively applied to line electrodes 101, 102, 108 to 110 and 124 have been shown. Those skilled in the art will be perfectly able to deduce the shape of the remaining line signals from the information provided here.

Each of line signals BP1 to BP24 can have up to four distinct voltage levels VLCD, V1, V4 and VSS. Voltages VLCD and VSS constitute activation levels and voltages V1 and V4 non-activation levels. It will be understood that a pixel is only capable of being activated by an appropriate column signal if the corresponding line signal is simultaneously brought to activation voltage level VCLD, respectively VSS. In the example illustrated in FIGS. 3A to 3C. non-activation voltages V1 and V4 are respectively defined at 83% and 17% of activation voltage VLCD, VSS being chosen as a reference at 0 volts.

During a first half-cycle, designated A in FIG. 3A, line signals BP1 to BP24 thus vary between activation voltage VSS and non-activation voltage V1. During the next half-cycle, designated B in FIG. 3A, line signals BP1 to BP24 vary between activation voltage VLCD and non-activation voltage V4.

More specifically, line signal BP1 is briefly brought to activation voltage VSS for a determined duration T at the beginning of the first half-cycle A in order to activate line 101 of the display, then remains constant at non-activation voltage V1 during the remainder of half-cycle A. During the next half-cycle B, line signal BP1 is reversed with respect to the preceding half-cycle, i.e. signal BP1 briefly passes to activation voltage VLCD for a determined duration T at the beginning of the next half-cycle B, then remains constant at non-activation voltage V4 during the remainder of half-cycle B.

In order to activate line 102 of the display, line signal BP2 is briefly brought to activation voltage VSS, respectively to activation voltage VLCD, during first half-cycle A, respectively during the second half-cycle B, just after the passage of line signal BP1 to the same activation levels. The remaining line signals BP3 to BP24 are arranged in a similar manner, line signal BP24 being thus brought to activation levels VSS, VLDC at the end of each half-cycle A, B.

It will thus be understood that each line signal BP1 to BP24 is sequentially brought once, during a half-cycle A, B, for a determined duration T, to activation voltage VSS, VLCD, such that the lines of the display are sequentially activated once during a half-cycle period.

The duration T during which the line signal is brought to the activation voltage is determined by the duration of each half-cycle, i.e. by the display frame frequency, and by the number of lines of the display, here twenty-four in number. In the example, illustrated, it will thus be understood that each line signal is brought to activation voltage VSS, VLCD during 1/24th of a half-cycle period. The rest of the time, the line signal is brought to non-activation voltage V1, respectively V4.

In brief, it will thus be understood that the lines are sequentially activated during each half-cycle, the activation and non-activation levels being alternated from one half-cycle to the next. At a given moment, only one line of the display is thus activated, the other lines all being controlled by the non-activation voltage, V1, V4.

Suitable column signals are applied to the electrodes (not shown) of columns 201 to 205 of display 10 in order to selectively activate or deactivate the pixels of the display. These line signals will be designated in the description hereinafter by the references FP1 to FP5, the signal FP1 corresponding to the column signal applied to the electrode of column 201, signal FP2 to the column signal applied to the electrode of column 202 and so on to signal FP5 applied to the electrode of column 205.

Figure 3B:
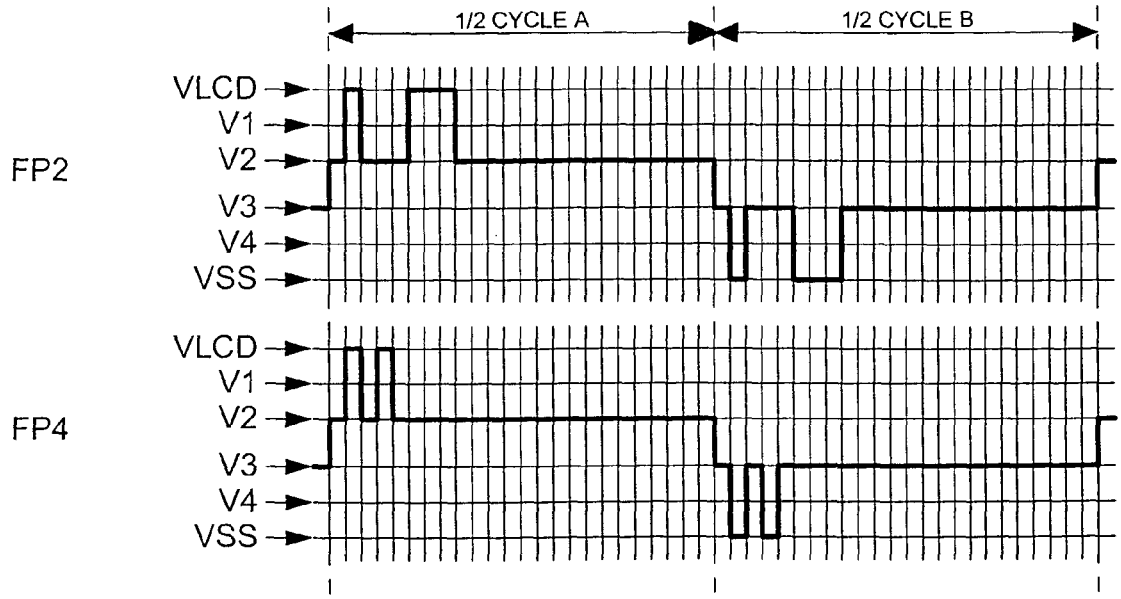

FIG. 3B illustrates, also in the first display operating mode, the shape of column signals FP1 to FP5 applied to the column electrodes (not shown) of display 10 of FIG. 2. Also for the sake of simplification, in FIG. 3B, only column signals FP2 and FP4 respectively applied to the electrodes of columns 202 and 204, have been shown, i.e. the electrodes comprising notably pixels 11, 12 and 13 taken by way of example. Those skilled in the art will be perfectly able to deduce the shape of the remaining column signals from FIG. 2 and FIG. 3B.

It will also be noted, in FIG. 3B, that column signals FP1 to FP5 can also take up to four distinct voltage levels VLDC, V2, V3 and VSS. Voltages V2 and V3 also constitute non-activation levels. It will be understood that a pixel is only capable of being activated by an appropriate line signal if the corresponding line signal is simultaneously brought to activation voltage level VLCD or VSS, depending on the half-cycle being considered. In the example illustrated in FIGS. 3A to 3C, non-activation voltages V2 and V3 are respectively defined at 66% and 34% of activation voltage VLCD.

During the first half-cycle A, columns signals FP1 to FP5 thus vary between activation voltage VLCD and non-activation voltage V2. During the next half-cycle B, columns signals FP1 to FP5 vary between activation voltage VSS and non-activation voltage V3.

More specifically, line signal FP2 illustrated in FIG. 3B is brought, at determined time intervals during first half cycle A, to activation voltage VLCD in order to activate the corresponding pixels in column 202 of the display, namely the pixels of lines 102 and 106 to 108. The rest of the time, during this first half-cycle A, the column signal is brought to non-activation level V2. During the next half-cycle B, column signal FP2 is reversed with respect to the preceding half-cycle, i.e. signal FP2 is brought to activation voltage VSS at determined time intervals corresponding to the activation of the pixels of lines 102 and 106 to 108, this signal FP2 being brought, the rest of the time, to non-activation level V3.

Similarly, the column signal FP4 illustrated in FIG. 3B is brought, at determined time intervals during first half-cycle A, to activation voltage VLCD in order to activate the corresponding pixels in column 204 of the display, namely the pixels of lines 102 and 104, this signal FP4 remaining at non-activation level V2 the rest of the time. During the next half-cycle B, signal FP4 is reversed and is thus brought to activation level VSS at time intervals corresponding to the activation of the pixels of lines 102 and 104, this signal FP4 being brought to non-activation level V3 the rest of the time.

It will thus be understood that each column signal FP1 to FP5 is brought selectively, during a half-cycle A, B, to activation voltage VLCD, VSS, in order to activate the corresponding pixels in each of columns 201 to 205 of the display. It will thus be understood that the signal for activating and deactivating the pixels in a column are multiplexed over time at each column signal FP1 to FP5.

The elementary duration during which the column signal is brought to activation voltage VLCD, VSS respectively, to allow a determined pixel in the column to be activated, corresponds to previously defined duration T with respect to line signals BP1 to BP24, i.e. 1/24th of a half-cycle period in this example. In other words, each half-cycle A, B is broken down in this operating mode into twenty-four sub-periods corresponding to twenty-four pixels capable of being activated in each column of the display.

It will likewise have been understood that the interval during which each of line signals BP1 to BP24 is brought to activation level VSS, VLCD respectively, appears sequentially, in line signals BP1 to BP24, at each of these twenty-four sub-periods.

In the description hereinafter, "multiplex rate" will mean a parameter determined by the number of so-called active display lines and defining the actual number of multiplexed lines on column signals FP1 to FP5. Thus, in the so-called normal operating mode, illustrated by FIGS. 3A to 3C, the twenty-four lines 101 to 124 of the display are active. In such case, one will speak of a multiplex rate of 1:24. It will be noted that duration T previously defined with respect to line signals BP1 to BP24, namely also the elementary duration during which the column signals are brought to the activation voltage to allow a determined pixel to be activated in the column, is directly linked to this parameter. It will thus be directly deduced from a multiplex rate of 1:24, that twenty-four active display lines are controlled and that, consequently, each half-cycle of lines signals BP1 to BP 24 and of column signals FP1 and FP5 is broken down into twenty-four sub-periods.

The multiplex rate thus determines the shape of line signals BP1 to BP24 as well as the intervals during which the column signals FP1 to FP5 have to be brought to activation level VLCD, VSS respectively, to selectively activate pixels.

Figure 4A:
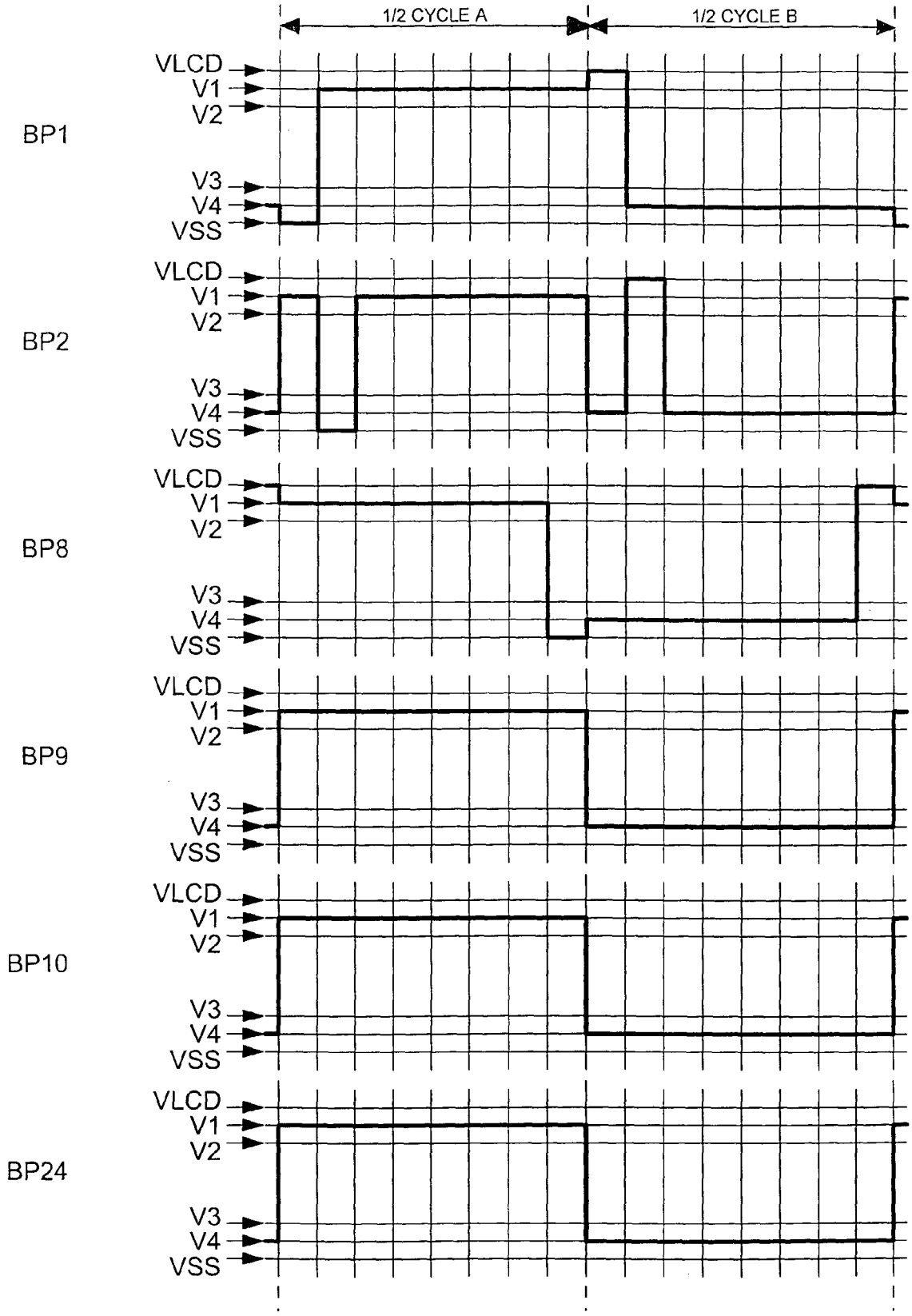
FIGS. 4A and 4B illustrate, in a second so-called standby operating mode in which only the first eight lines of the display are active, examples of signals able to be applied respectively to the lines and columns of the display of FIG. 2 to selectively activate or deactivate pixels of said display.
Figure 4B:
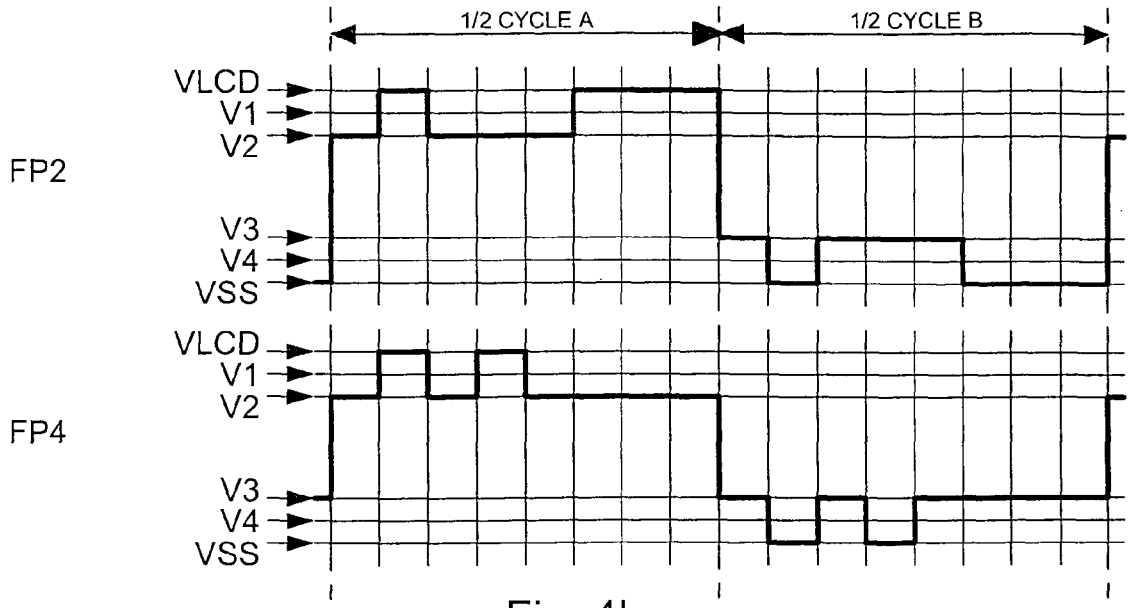
Figure 4C:
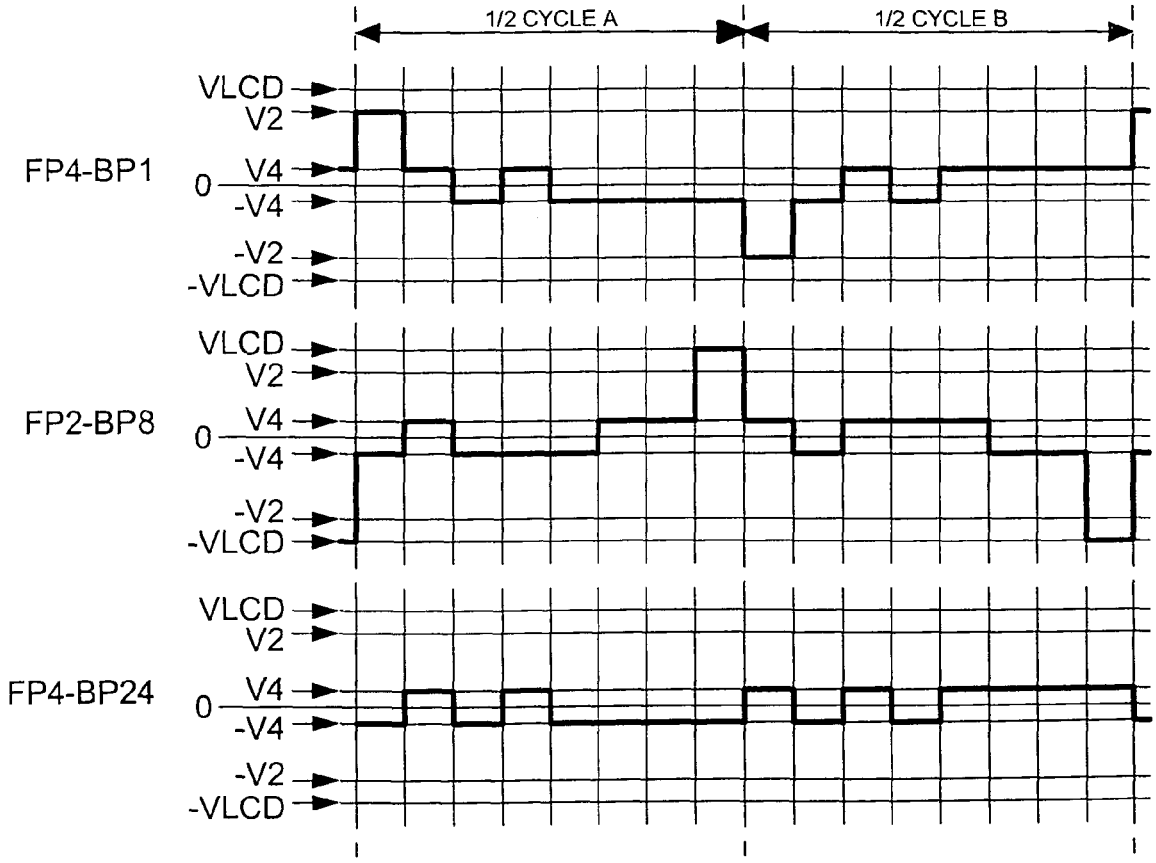
FIG. 4C illustrates, in the second operating mode, the signals present at the terminals of three pixels of the display of FIG. 2, these signals resulting from the combination of signals, illustrated in FIGS. 4A and 4B, applied to the corresponding lines and columns of the display.

In the description hereinafter, it will be seen that, according to the present invention, in at least a second so-called standby operating mode in which a set of lines from among the display lines is deactivated, the multiplex rate is reduced in proportion to the number of inactive lines. According to the particular implementation of the invention used and described hereinafter solely by way of example, only eight lines of the display will remain active in this standby operating mode. According to this illustrative implementation of the present invention, the multiplex rate will thus be reduced to 1:8 meaning that each half-cycle A, B is then broken down into eight sub-periods. FIGS. 4A to 4C will subsequently prove this point.

It will of course be understood that the invention is not limited just to the implementation modes described in the description hereinafter, namely implementation modes wherein only eight lines are activated in standby operating mode. Those skilled in the art will be perfectly able to adapt the method and the device according to the present invention so that a different number of lines are active in standby operating mode.

Figure 3C:
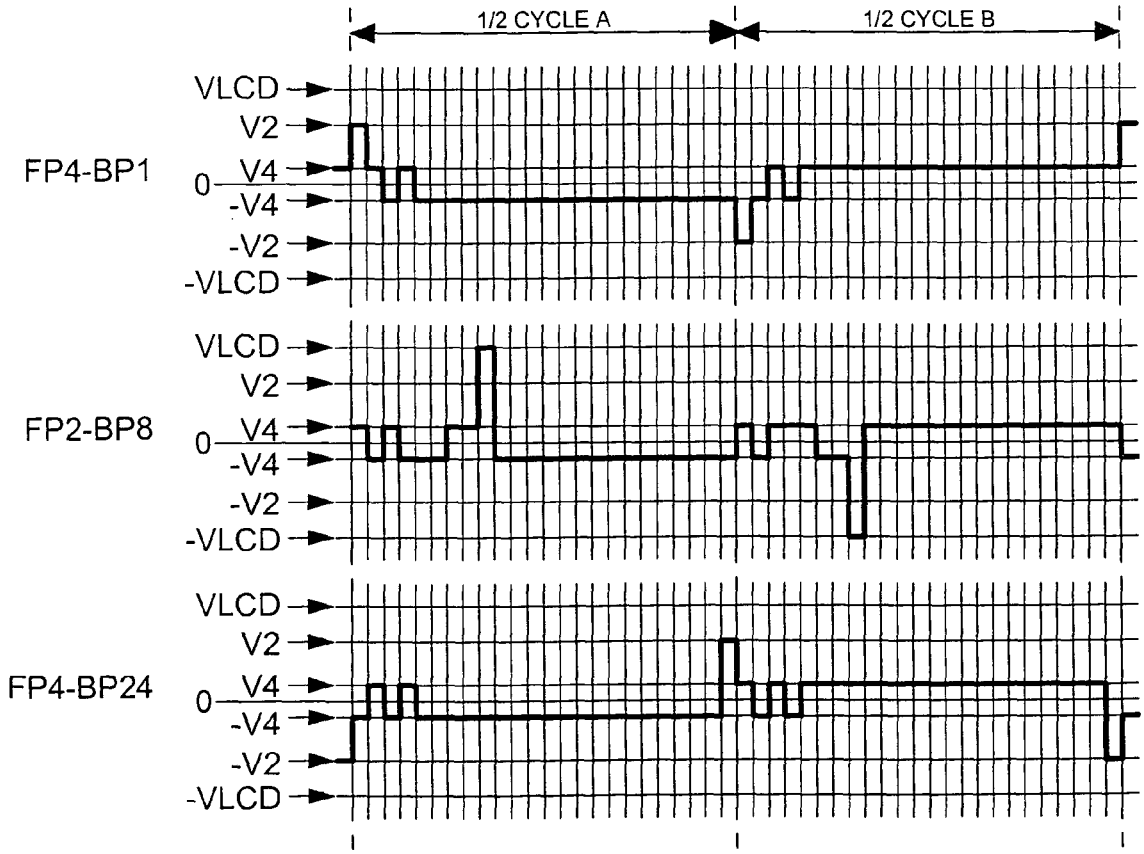
FIG. 3C illustrates, in the first operating mode, the signals present at the terminals of the three pixels of the display of FIG. 2, these signals resulting from the combination of signals, illustrated in FIGS. 3A and 3B, applied to the corresponding lines and columns of the display.

FIG. 3C illustrates the signals at the terminals of pixels 11, 12, 13 resulting from the combination of corresponding line and column signals. The three signals shown thus correspond respectively to the signal present at the terminals of pixel 11 resulting from the difference FP4–BP1 of column signal FP4 and of line signal BP1, to the signal present at the terminals of pixel 12 resulting from the difference FP2–BP8 of column signal FP2 and of line signal BP8 and to the signal present at the terminals of pixel 13 resulting from the difference FP4–BP24 of column signal FP4 and line signal BP24.

From examining FIG. 3C, the following observations can be made. As was already mentioned in the preamble, activation voltage levels VSS, VLCD and non activation voltage levels V1 to V4 are chosen such that the resulting signals at the terminals of the pixels have, over a period of two successive half-cycles, i.e. over a period covering half-cycles A and B of FIG. 3C, a substantially zero mean value.

More specifically, non-activation levels V1 to V4 are chosen, in the example illustrated in FIGS. 3A to 3C, as fractions of activation voltage VLCD (VSS being fixed, as reference, at 0 volts) and such that the resulting voltage at the terminals of each pixel has a value of +/−V4 during twenty-three of the twenty-four sub-periods of each half-cycle, and +/−VLCD or +/−V2 during one of the twenty-four sub-periods depending on whether the pixel is respectively active or inactive. In order to satisfy this condition, it will be observed that non-activation voltages V1, V2 and V3 have respective values of VLCD−V4, VLCD−2·V4 and 2·V4.

As a result of this choice, the signal present at the terminals of each pixel during half-cycle B is reversed with respect to the preceding half-cycle A. The mean value of the signal over a period covering half-cycles A, B is thus actually zero.

With reference to the first signal of FIG. 3C, illustrating signal FB4–BP1 present at the terminals of the pixel in the non-active state 11, it will be observed that during first half-cycle A, this signal is at +V2 during the first sub-period of the half-cycle, then varies between +/−V4 during the twenty-three remaining sub-periods. During the following half-cycle B, the signal is reversed with respect to the preceding half-cycle A.

Likewise, with reference to the third signal of FIG. 3C, illustrating signal FP4–BP24 present at the terminals of the pixel in the non-active state 13, it is observed that this signal is at +V2, respectively −V2, during the last sub-period of first half-cycle A, respectively of the next half-cycle B, this signal being at +/−V4 the rest of the time.

With reference to the second signal of FIG. 3C, illustrating signal FP2–BP8 present at the terminals of the pixel in the active state 12, it will be observed that during half-cycles A, B, this signal is at +VLCD, respectively −VCLD, during the eighth sub-period of the half-cycle, and varies between +/−V4 during the other twenty-three sub-periods.

According to the present invention, in at least a second so-called standby operating mode, a set of so-called non-active lines, from among lines 101 to 124 of the display is deactivated. In the example illustrated in FIG. 2, one has chosen, for example, to deactivate lines 109 to 124 of display 10 and to only keep the first eight lines of the display active, namely lines 101 to 108.

It will be understood of course that those skilled in the art are free to choose the number of lines that have to be deactivated and which display lines will actually be deactivated. FIGS. 4A to 4C only illustrate one choice among many. One could, for example, choose to keep first line 101 (as a line of symbols) and the last seven display lines 118 to 124 active.

In FIGS. 4A to 4C, for the sake of simplification, one has chosen to show the signals with an identical number of activation and non-activation levels. These activation and non-activation levels are also designated VSS, VLCD and V1, V2, V3, V4 respectively. It will be noted however that the distribution of non-activation levels V1 to V4 is different, in this second operating mode. In the example illustrated in FIGS. 4A to 4C, the non-activation voltages V1 to V4 are respectively defined at 90%, 80%, 20% and 10% of activation voltage VLCD. The reasons for this choice; which is in no way limiting, will be presented hereinafter. For the moment, it need only be understood that this non-activation voltage distribution V1 to V4 is chosen in order to compensate for the increase in display contrast when the normal operating mode passes to the standby operating mode.

It will be seen hereinafter that the reduction in the multiplex rate also leads to a reduction in activation voltage VLCD, this forming an additional advantage with respect to the state of the art as regards reducing the power consumption of the display.

The signals applied to columns 201 to 205 of the display and the signals applied to active lines 101 to 108 of the display are similar to the signals applied during the first operating mode or normal mode. However, unlike the first operating mode, the multiplex rate is reduced in proportion to the number of deactivated lines. In this implementation of the present invention, the multiplex rate is thus reduced by way of example from 1:24, in normal operating mode, to 1:8 in standby operating mode. Consequently, the shape of line signals BP1 to BP8, respectively column signals FP1 to FP5 is changed as illustrated in FIGS. 4A and 4B. Each half-cycles A, B of line signals BP1 to BP8 respectively column signals FP1 to FP% is thus broken down, in this second operating mode, into eight sub-periods.

FIG. 4A illustrates, in the second operating mode of the display, the shape of line signals BP1 to BP24 applied to the line electrodes of the display. For the sake of simplification, in FIG. 4A, once again only line signals BP1, BP2, BP8 to BP10 and BP24 applied respectively to line electrodes 101, 102, 108 to 110 and 124 have been shown. Those skilled in the art will be perfectly able to deduce the shape of the remaining line signals from the information given here.

The shape of line signals BP1 to BP8 applied, in the second operating mode, to active lines 101 to 108 of the display is similar to the shape of line signals BP1 to BP24 applied to lines 101 to 124 in the first operating mode. However, in accordance with the implementation of the invention used here by way of example, given that the multiplex rate is reduced to 1:8 in this second operating mode, it will be noted that duration T during which each of line signals BP1 to BP8 is brought to activation level VSS, respectively VLCD, is greater, in this second operating mode, compared to the same duration T, in the first operating mode.

During first half-cycle A, line signals BP1 to BP8 vary between activation voltage VSS and non-activation voltage V1. During the next half-cycle B, line signals BP1 to BP8 vary between activation voltage VLCD and non-activation voltage V4.

More specifically, line signal BP1 is briefly brought, at the beginning of each half-cycle A, B to activation voltage VSS, respectively VLCD, during $1/8^{th}$ of the half-cycle period in order to activate line 101 of the display, then remains constant at non-activation voltage V1, respectively V4 during the rest of the half-cycle.

In order to activate line 102 of the display, line signal BP2 is briefly brought to activation level VSS, respectively VLCD, during each half-cycle A, B, just after line signal BP1 passes to these same activation levels. Line signals BP3 to BP8 are arranged in a similar manner, line signal BP8 thus being brought to activation levels VSS, respectively VLCD, at the end of each half-cycle A, B, as illustrated in FIG. 4A.

It will thus be understood that each line signal BP1 to BP8 is sequentially brought once during a half-cycle A,B, during $1/8^{th}$ of a half-cycle period, to activation voltage VSS, VLCD, such that active lines 101 to 108 of the display are sequentially activated once during a half-cycle period.

In order to keep lines 109 to 124 of the display non-active, in this second operating mode, so-called non-activation line signals are applied to the electrodes of corresponding lines 109 to 124. These signals are chosen such that, when they are combined with column signals FP1 to FP5, each pixel in these inactive lines 109 to 124 receives at its terminals a signal whose amplitude is too low to activate it. Thus, line non-activation signals are applied, which are brought, during the entire duration of first half-cycle A, to non-activation level V1, then, during the entire duration of the next half-cycle B, to non-activation level V4.

FIG. 4B illustrates, also in the second operating mode of the display, the shape of column signals FP1 to FP5 applied to the column electrodes (not shown) of display 10 of FIG. 2. Also for the sake of simplification, in FIG. 4B, only column signals FP2 and FP4 have been shown, applied respectively to the electrodes of columns 202 and 204, i.e. the electrodes comprising notably pixels 11,12 and 13 taken by way of example. Those skilled in the art will be perfectly able to deduce the shape of the remaining column signals from FIG. 2 and FIG. 4B.

Disregarding the activation and non-activation levels, the shape of column signals FP1 to FP5 applied, in the second operating mode, to columns 201 to 205 of the display is similar to the shape of the signals applied to the same columns in the first operating mode. However, according to the implementation of the invention used here by way of example, given that the multiplex rate is reduced to 1:8 in this second operating mode, it will be noted that the time intervals during which column signals FP1 to FP5 are brought to activation levels VLCD, VSS in order to activate the desired pixels are greater, in this second operating mode, compared to the same intervals, in the first operating mode.

One could in a way consider that line signals BP1 to BP8 as well as column signals FP1 to FP5, in the second operating mode, are obtained by spreading the first eight sub-periods of the same signals, over the entire duration of a half-cycle, in the first operating mode.

With reference now to FIG. 4C, the shape of the signals at the terminals of pixels 11, 12 13 resulting from the combination of the corresponding line and column signals, will now be examined.

It will be noted first of all that all the signals present at the terminals of the pixels have, over a period of two successive half-cycles, a substantially zero mean value. It will be noted, however, that the signals of FIG. 4C have a similar shape to the signals of FIG. 3C, if only the first eight sub-periods of said signals are considered.

With reference to the first signal of FIG. 4C, illustrating signal FP4−BP1 present at the terminals of the pixel in the non-active state 11, it is observed that during the first half-cycle A, this signal is at +V2 during the first sub-period of the half-cycle, then varies between +/−V4 during the seven remaining sub-periods. During the next sub-period B, the signal is reversed with respect to the preceding half-cycle A.

Likewise, referring to the second signal of FIG. 4C, illustrating signal FP2−FP8 present at the terminals of the pixel in the active state 12, it is observed that this signal is at +VLCD, respectively −VLCD, during the eighth and last sub-period of the first half-cycle A, respectively of the following half-cycle B, this signal being at +/−V4 the rest of the time.

With reference to the third signal of FIG. 4C, illustrating signal FP4−BP24 present at the terminals of the pixel in the non-active state 13, it will be noted that, following the reduction in the multiplex rate, the signal present at the terminals of pixel 13 varies only between +/−V4 and no longer has a peak at +/−V2 at the end of each half-cycle. Since this peak is due, in the first operating mode, to the activation pulse of line signal BP24 of line 124 of the display, the latter obviously no longer appears since a non-activation line signal is applied to the same line during the second operating mode.

The influence of the reduction in the multiplex rate during passage from normal operation mode to standby operating mode should now be examined. Those skilled in the art will generally seek to optimise, in this case, to maximise the display contrast, i.e. to maximise the ratio between the intensity of a pixel in the active state and the intensity of a pixel in the non-active state. In order to maximise such contrast, one has to act on the values of non-activation voltages V1 to V4, or more exactly on the distribution of such non-activation voltages. The following description will allow the existence of an optimum, in terms of contrast, to be demonstrated for determined values of the non-activation voltages.

For the purposes of the explanation, it will be useful to define non-activation voltages V1 to V4 in the following manner. By defining V4 as being equal to a fraction of activation voltage VLCD, namely V4=αVLCD, where α is a distribution parameter, one can define, in accordance with the foregoing that V1=(1−α) VLCD, V2=(1−2α) VLCD, and V3=2α VLCD. It will be noted that distribution parameter a is comprised between 0 and 50%.

The effective values or value rms of the signal present at the terminals of each pixel in the active state will also be defined, namely respectively the following values $V_{ON,rms}$ and $V_{OFF,rms}$.

$$V_{ON,rms} = \sqrt{\frac{(n-1)\alpha^2+1}{n}} \cdot V_{LCD} \quad (1)$$

$$V_{OFF,rms} = \sqrt{\frac{(n-1)\alpha^2+(1-2\alpha)^2}{n}} \cdot V_{LCD} \quad (2)$$

where n is defined as the number of active lines of the display; 1:n being in this case the multiplex rate.

It will thus be understood that the aforementioned values $V_{ON,rms}$ and $V_{OFF,rms}$ are directly dependent upon the number of active lines of the display, namely upon the multiplex rate. It will also be observed that these values $V_{ON,rms}$ and $V_{OFF,rms}$ increase when there is a reduction in the multiplex rate.

In order to maximise contrast, non-activation voltages V1 to V4, or, in other words, distribution parameter α will preferably be chosen such that the ratio $V_{ON,rms}/V_{OFF,rms}$ is maximum. This optimum is obtained, after mathematical development, for a value of parameter α such that:

$$\alpha = \frac{\sqrt{n}-1}{n-1} \quad (3)$$

It will thus be observed that the optimum is different for each multiplex rate. With a multiplex rate of 1:24 for example, i.e. twenty-four active lines, this parameter α has a value of approximately 17%. In such case, the non-activation levels are preferably chosen such that V1=83% VLCD, V2=66% VLCD, V3=34% and V4=17% VLCD as is illustrated for example in FIGS. 3A to 3C.

Likewise, with a multiplex rate of 1:8, i.e. eight active lines, this parameter a has a value of approximately 25%. In such case, the non-activation levels are thus preferably chosen such that V1=75% VLCD, V2=V3=50% VLCD and V4=25% VLCD, such that only three non-activation levels are then necessary.

Figure 5A:
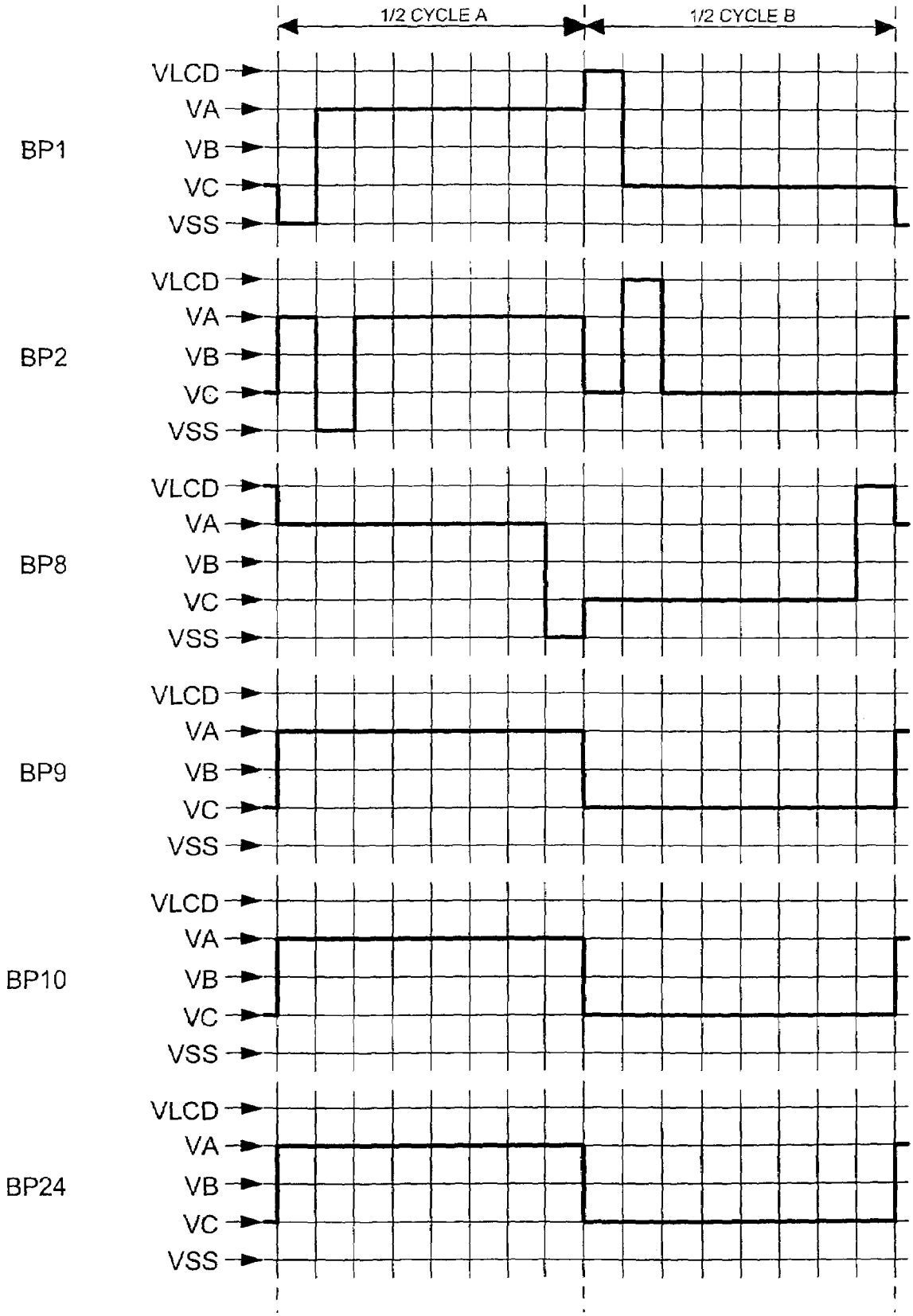
FIGS. 5A and 5B illustrate, in. the second so-called standby operating mode in which only the first eight lines of the display are active, other examples of signals able to be applied respectively to the lines and columns of the display of FIG. 2 to selectively activate or deactivate pixels of said display.
Figure 5B:
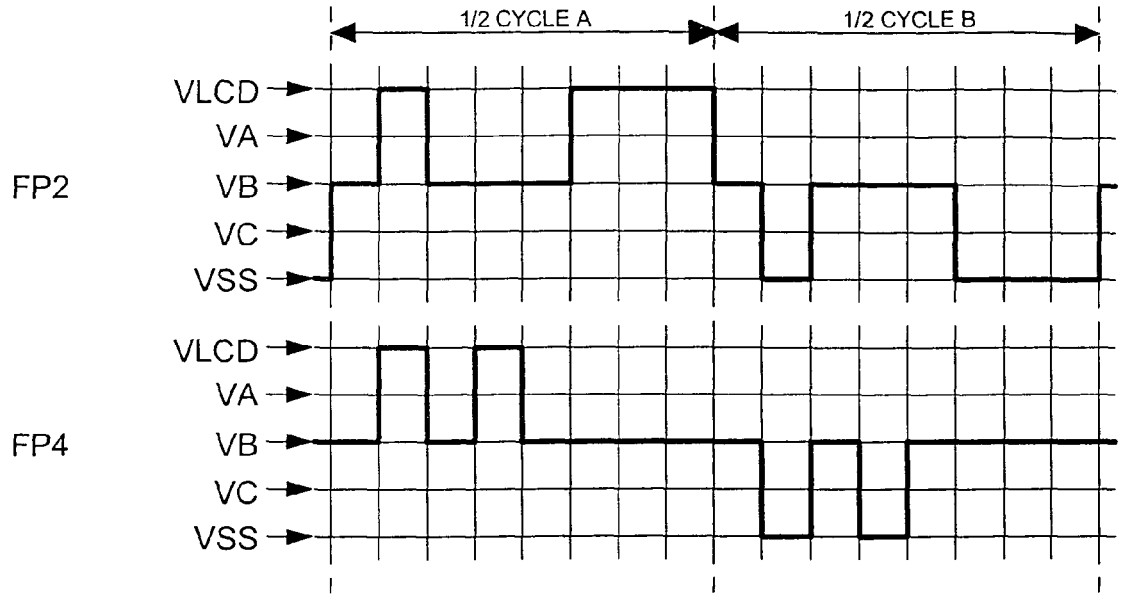
Figure 5C:
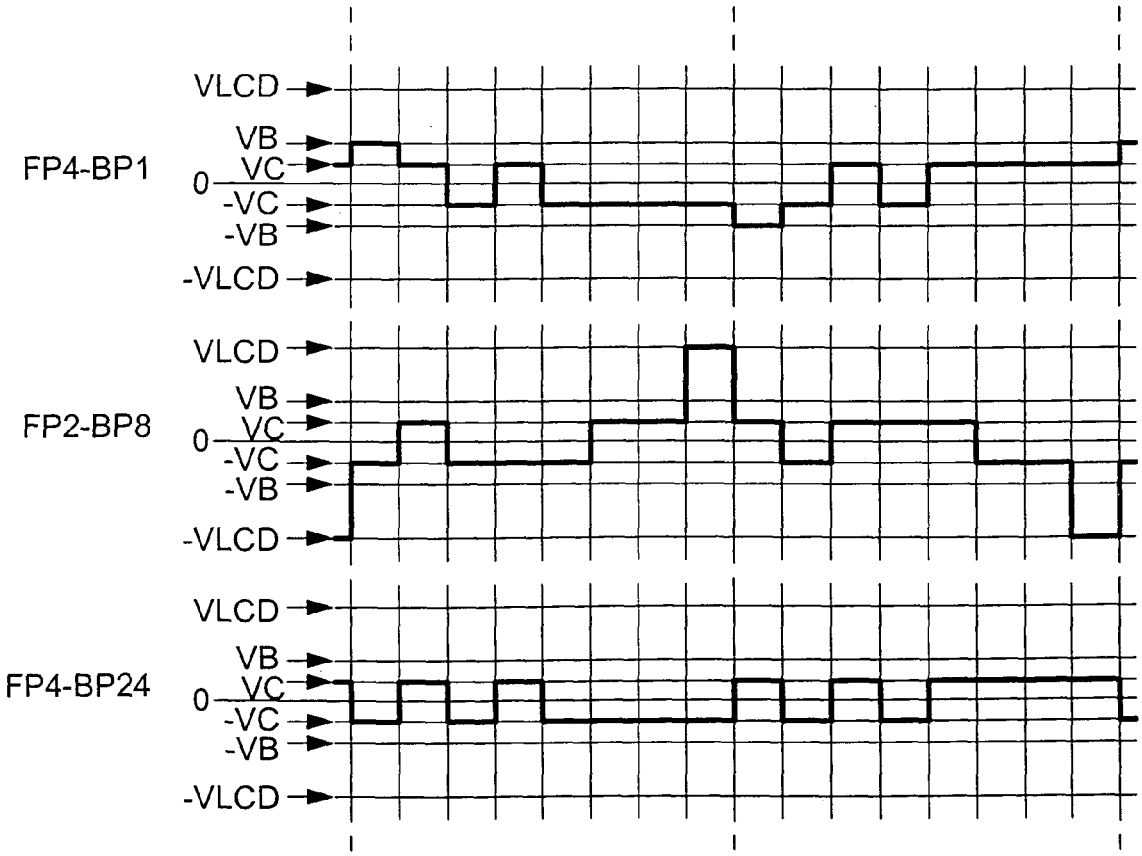
FIG. 5C illustrates, in the second operating mode, the signals present at the terminals of three pixels of the display of FIG. 2, these signals resulting from the combination of signals, illustrated in FIGS. 5A and 5B, applied to the corresponding lines and columns of the display.

FIGS. 5A to 5C illustrate, in the second operating mode in which the multiplex rate has a value of 1:8, other examples of line signals BP1 to BP24, column signals FP1 to FP5 and resulting signals present at the terminals of pixels 11, 12, 13 in the event that the parameter α is chosen to be 25% in order to optimise the display contrast for this multiplex rate, only three non-activation levels thus being required in this case. In FIGS. 5A to 5C, these non-activation levels are designated VA, VB and VC to avoid any confusion, where VA=75% VLCD, VB=50% VLCD and VC=25% VLCD. These signals will not be described again, since they are similar, except for the distribution of non-activation signals, to the signals illustrated in FIGS. 4A to 4C. It will simply be noted that the column signals, such as signals FP2 and FP4 illustrated in FIG. 4B, have only one non-activation level VB in this case.

According to a first variant, one can thus choose to optimise the display contrast for each operating mode and consequently to choose the distribution (aforementioned parameter α) of the non-activation voltages. According to this first variant, it will be noted however that the contrast (ratio $V_{ON,rms}/V_{OFF,ms}$) increases during the passage from normal operating mode to standby operating mode. This increase in contrast may be deemed unpleasant for the user.

According to a preferred variant of the invention, the non-activation voltage distribution is adjusted from one operating mode to another so as to keep the contrast substantially constant. By way of example, by adopting a distribution of non-activation levels V1 to V4 in accordance with the illustration of FIGS. 3A to 3C such that distribution parameter α=17% in order to optimise the contrast in normal operating mode, it can be determined that the distribution of non-activation levels V1 to V4, in standby operating mode in which the multiplex rate equal 1:8, according to the implementation of the invention used here by way of example, has to be such that distribution parameter a is substantially equal to 10%. In such case, non-activation voltages V1 to V4 are thus respectively defined at 90%, 80%, 20% and 10% of activation voltage VLCD in accordance with the illustration of FIGS. 4A to 4C.

It will, of course, be clear that other non-activation voltage distributions can be envisaged to keep the display contrast constant from one operating mode to another.

The user could also decide not to adjust the contrast and tolerate a slight variation in the latter.

In any event, the reduction in the multiplex rate during the passage from normal operating mode to standby operating mode is also accompanied by a reduction in activation voltage VLCD (activation voltage VSS is chosen as reference at 0 volts in both modes). Indeed, as was already mentioned hereinbefore, the effective values or rms values $V_{ON,rms}$ and $V_{OFF,rms}$ increase when there is a reduction in the multiplex rate. Activation voltage VLCD should also be adjusted in order, for example, for efficient value $V_{OFF,rms}$ of the signal present at the terminals of a pixel in the nonactive state to be substantially constant from one operating mode to another.

Taking, by way of example, the variant illustrated in FIGS. 3A to 3C and 4A to 4C, i.e. the variant wherein the distribution of non-activation voltages V1 to V4 is such that α=17% in normal operating mode and α=10% in standby operating mode in order to keep the display contrast constant, one obtains $V_{OFF,rms}$=21.4% VLCD in normal operating mode and $V_{OFF,rms}$ 29.8% VLCD in standby operating mode. One can thus reduce activation voltage VLCD, in standby operating mode, to 21.4/29.8=71.8% of voltage VLCD used in normal operating mode. This reduction in activation voltage VLCD ensures an additional reduction in the power consumption of the display. Generally, one will be able to note that the present invention has multiple advantages. First of all, the reduction in the multiplex rate and thus in the signal multiplexing frequency allows the number of switches on the display line and column electrodes to be reduced. For example, according to the implementation of the invention used by way of example here, during the passage from multiplex rate 1:24 to multiplex rate 1:8, the multiplexing frequency is divided by three. Moreover, the multiplex rate reduction allows pixel activation voltage VLCD to be reduced, as already mentioned above. Finally, the multiplex rate reduction generates an increase in the display contrast which may or may not be adjusted by the user.

The Applicant has been able to observe that for a multiplexed display device including twenty-four active lines in normal operating mode and eight active lines in standby operating mode, a power consumption reduction of the order of two thirds, as a minimum, was obtained (activation voltage VLCD being reduced during passage to standby operating mode).

The control method which has just been described can thus be applied so as to switch a multiplexed display between a first so-called normal operating mode (all the lines active) and at least a second so-called standby operating mode (one or more lines inactive). This switching between modes can be performed by means of software by programming the control device in an appropriate manner or materially by using dedicated circuits. This switching can be automatic if desired.

An embodiment of a multiplexed display control device for implementing the previously described method will now be described by means of FIG. 6 and in accordance with another aspect of the invention.

Figure 6:
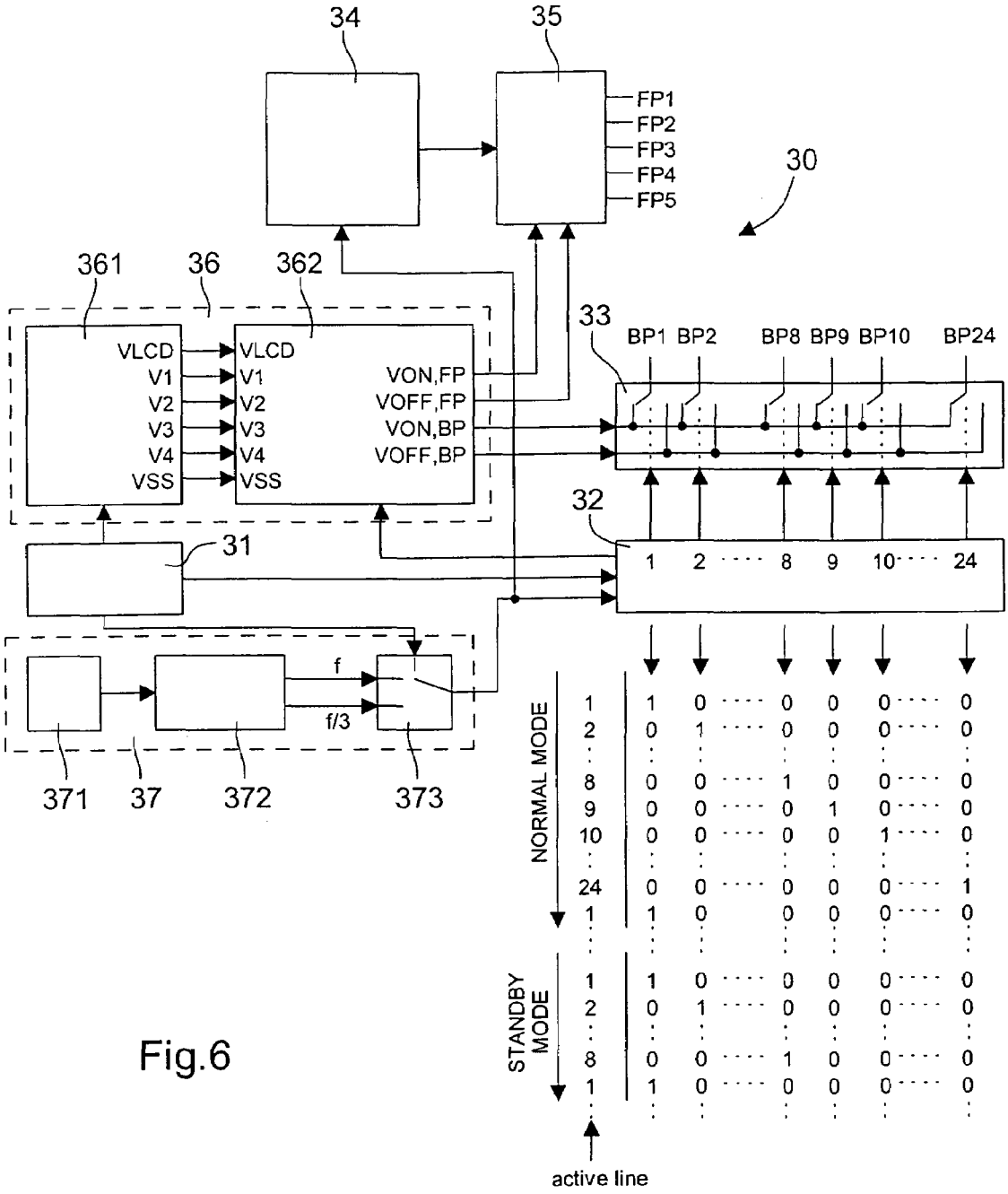
FIG. 6 shows schematically an example embodiment of a multiplexed display control device for implementing the control method according to the present invention.

FIG. 6 thus shows schematically a control device or circuit for a multiplexed display, designated as a whole by the reference numeral 30. This device 30 includes a mode switch 31, a programmable sequencer 32, a line signal generator 33, shaping means 34, a column signal generator 35, an activation and non-activation voltage generator 36 and a frequency generator 37.

Mode switch 31, as its name indicates, switches automatically or manually, between normal operating mode and standby operating mode. It controls the operation of programmable sequencer 32, activation and non-activation voltage generator 36 and that of frequency generator 37.

Activation and non-activation voltage generator 36 is arranged to generate at its output activation and non-activation voltages that have to be applied to the display lines and columns. In particular, this generator 36 generates at its output activation VON,BP and non-activation VOFF,BP voltages for the display lines. These voltages VON,BP and VOFF,BP are applied to line signal generator 33. The generator also produces at its output activation VON,FP and non-activation VOFF,FP voltages for the display columns. These voltages VON,FP and VOFF,FP are applied to column signal generator 35.

The voltages generated at the output of activation and non-activation voltage generator 36 are alternated from one half-cycle to another as was seen hereinbefore. Generator 36 is thus controlled by programmable sequencer 32 so as to assure this alternation of activation and non-activation voltages.

Generator 36 is controlled by mode switch 31 such that the activation and non-activation voltage levels are modified during the passage from normal operating mode to standby operating mode. In particular, this generator 36 is arranged, on the one hand, to decrease the value of activation voltage VLCD (VSS being chosen as reference at 0 volts) in response to the passage from normal operating mode to the standby operating mode, and to modify, on the other hand, the distribution of non-activation voltages V1 to V4 in accordance with the foregoing.

More specifically, activation and non-activation voltage generator 36 can be broken down into a first unit 361 controlled by the mode switch and allowing activation voltages VSS, VLCD and non-activation voltages V1 to V4 to be generated, and a second unit 362 controlled by programmable sequencer 32 so as to alternate the activation and non-activation voltages from one half-cycle to another.

Frequency generator 37 includes an oscillator 371, a frequency divider circuit 372 and a frequency switch 373. Oscillator 371 and frequency divider circuit 372 are arranged to generate a signal whose frequency determines the shape of the line and column signals. In the particular case, oscillator 371 and frequency divider circuit 372 are arranged to deliver a first frequency at a frequency f, called the multiplexing frequency, intended for the first operating mode and a second signal at a frequency f/3 intended for the second operating mode. Frequency switch 373, controlled by mode switch 31, delivers at its output a frequency multiplexing signal f during the first mode and a frequency multiplexing signal f/3 during the second mode. This multiplexing signal is applied to programmable sequencer 32 and to shaping means 34.

Programmable sequencer 32 assures the adequate sequence for generating the signals intended to be applied to the display line electrodes, like signals BP1 to BP24 presented previously. This programmable sequencer 32 is thus connected to line signal generator 33. In the example illustrated, programmable sequencer 32 includes twenty-four outputs, connected to line signal generator 33, each of these outputs controlling the switching, in line signal generator 33, between activation voltage VON,BP and non-activation voltage VOFF,BP in accordance with the sequence described hereinbefore. Line signal generator 33 includes twenty-four outputs, in this example, to which line signals BP1 to BP24 are respectively generated.

In normal operating mode, sequencer 32 generates the adequate sequence for activating sequentially all the display lines, i.e. the twenty-four lines of the display in this example. Generator 33 generates in response twenty-four line signals BP1 to BP24 like the signals illustrated in FIG. 3A.

In FIG. 6, the state of the outputs of sequencer 32 is schematised in normal operating mode over a duration of a half-cycle. The state of the outputs of sequencer 32 during a half-cycle can for example be schematised, in normal operating mode by a diagonal matrix, here a 24×24 matrix in which "1" and "0" correspond to switching the corresponding line signal respectively to the activation voltage and to the non-activation voltage.

In standby operating mode, sequencer 32 generates the adequate sequence for activating the first eight lines of the display in this example. The last sixteen lines of the display are all kept in a non-active state. In order to do this, the first eight outputs of the sequencer (from the left in FIG. 6) sequentially controls the switching of the first eight corresponding outputs of generator 33 between the activation and non-activation voltages in order to generate adequate signals BP1 to BP8 as illustrated in FIG. 4A or 5A. The last sixteen outputs of sequencer 32 keep the sixteen corresponding outputs of generator 33 at the non-activation voltage. Line signals BP9 to BP24 thus generated are in accordance with the illustration of FIG. 4A or 5A.

In standby operating mode, the state of the first eight outputs (from the left) of sequencer 32 can thus be schematised by an 8×8 diagonal matrix, in this example, the other sixteen outputs being still kept at "0".

Shaping means 24 assure, as a function of the data to be displayed, the shaping of the column signals, in the example illustrated, the column signals FP1 to FP5. Shaping means 34 controls column signal generator 35 in a suitable manner.

In a similar way to line signal generator 33, column signal generator 35 assures suitable switching, for each display column of the column signals, here FP1 to FP5, between activation and non-activation voltages VON,FP and VOFF, FP generated by voltage generator 36.

It will be clear that various modifications can be made to the control device illustrated in FIG. 6 without departing from the scope of the invention. In particular, it will be understood that it may perfectly well be envisaged to programme sequencer 32 such that eight other lines of the display are kept active in the second operating mode, such as for example the first and last seven lines of the display. Moreover, both the total number of lines of the display and the number of lines remaining active during the second operating mode can be changed. It will be recalled nonetheless that these changes influence notably the multiplexing frequency of the device as well as the activation and non-activation voltages required.

It will also be clear that the multiplex rate in normal operating mode is essentially fixed by the number of display lines. The multiplex rate in standby operating mode may perfectly well be able to be programmed so as to be modified in accordance with the wishes of the user or the designer of the display.

By way of variant, it will be clear that the present invention can be adapted such that the display can occupy more than one standby operating mode, for example a first standby operating mode in which the multiplex rate is divided by two, a second standby operating mode in which the multiplex rate is divided by three, etc. All of this can perfectly well be programmed. The present invention is thus in no way limited to a display able to occupy only one normal operating mode and a single standby operating mode, but applies in a similar manner if one wishes to provide more than one standby operating mode.

It will also be clear that the control method and device are not limited only to the particular implementations described in the present description. In particular, the method or the device of course apply similarly to a display comprising a different number of active lines to twenty-four in normal operating mode and a different number of active lines to eight in standby operating mode. It will be recalled again that the Figures illustrate only a few particular, non-limiting implementations of the present invention.

The invention claimed is:

1. A control method for a multiplexed display comprising a plurality of pixels arranged in lines and in columns and coupled to line electrodes and column electrodes, each of said pixels being selectively activated or deactivated by a determined combination of a line signal and of a column signal respectively applied to the corresponding line and column electrodes, these line and column signals varying between a ground voltage, an activation voltage and a plurality of non-activation voltages, so-called active lines of the display being sequentially activated once during a period of a half-cycle, method according to which said display is operated in a first so-called normal operating mode wherein all the lines of the display are activated, said line and column signals having a first so-called normal multiplex rate in said first operating mode, wherein:

said display is switched into at least a second so-called standby operating mode, where so-called non-active lines of the display are deactivated by applying, to the corresponding line electrodes, so-called non-activation line signals, these non-activation line signals being determined such that, when they are combined with the column signals, each pixel of said non-active lines receives at its terminals a signal whose amplitude is too low to activate it, so that the multiplexing rate of the display is 1:n, where n is an integer representing the number of active line electrodes, in said at least one second operating mode, one acts on the line signals applied to the active lines and on said column signals such that they have a second multiplex rate corresponding to the number of active lines in said at least second operating mode and whose value is reduced, with respect to said first multiplex rate, in proportion to the number of non-active lines, each line signal being sequentially brought once, during a half-cycle, for a determined duration, to activation voltage, such that the lines of the display are sequentially activated once during a half cycle period, and during the passage from the first to said at least second operating mode, the value of said activation voltage is reduced so as to compensate for the increase in the effective value of the signal present at the terminals of a non-active pixel, allowing a reduction of the refreshing frequency and a reduction of the activation voltage.

2. The method according to claim 1, wherein:

said line signals vary, during a first half-cycle, between the ground voltage and a first non-activation voltage, and, during a following half-cycle, between the activation voltage and a second non-activation voltage, said column signals vary, during the first half-cycle, between said activation voltage and a third non-activation voltage, and, during the following half-cycle, between said ground voltage and a fourth non-activation voltage, said non-activation line signals are brought, during the entire duration of said first half-cycle, to said first non-activation voltage, and, during the entire duration of said following half-cycle, to said second non-activation voltage, said activation and non-activation voltages being chosen such that, over a period of two successive half-cycles, the mean value of the signal present at the terminals of each pixel is substantially zero.

3. The method according to claim 2, wherein said non-activation voltages are determined, for each operating mode, so as to maximise the display contrast.

4. The method according to claim 2, wherein said non-activation voltages are determined such that the display contrast remains substantially constant during the passage from the first to said at least second operating mode.

5. A control device for a multiplexed display comprising a plurality of pixels arranged in lines and in columns and coupled to line electrodes and column electrodes, each of said pixels being selectively activated or deactivated by a determined combination of a line signal and of a column signal respectively applied to the corresponding line and column electrodes, so-called active lines of the display being sequentially activated once during a period of a half-cycle, said device being able to operate in a first so-called normal operating mode wherein all the lines of the display are activated, said line and column signals having a first so-called normal multiplex rate in said first operating mode, said control device including:

frequency generator means for generating a multiplexing signal having a frequency, in said first operating mode, determining said first multiplex rate, means for generating said line signals controlled by said multiplexing signal;

means for generating said column signals controlled by said multiplexing signal; and voltage generating means for generating activation and non-activation voltages intended for said line and column signal generating means, said line and column signals varying between a ground voltage, an activation voltage and a plurality of non-activation voltages; wherein:

the device further includes mode switching means arranged for switching the device between said first operating mode and at least a second so-called standby operating mode, where so-called non-active lines of the display are deactivated, these mode switching means controlling said line signal generating means, said voltage generating means and said frequency generating means, said frequency generating means are arranged to reduce the frequency of the multiplexing signal in proportion to the number of non-active lines, in response to the passage into said at least second operating mode, such that the line signals applied to the active line electrodes and said column signals have a second multiplex rate corresponding to the number of active lines in said at least second operating mode and whose value is reduced, with respect to said first multiplexing mode, in proportion to the number of non-active lines, each line signal being sequentially brought once, during a half-cycle, for a determined duration, to activation voltage, such that the lines of the display are sequentially activated once during half-cycle period, said line signal generating means are arranged to generate, in said at least second operating mode, so-called non-activation line signals to the non-active line electrodes, these non-activation line signals being determined such that, when they are combined with the column signals, each pixel of said non-active lines receives at its terminals a signal whose amplitude is too low to activate it so that the multiplexing rate of the display is 1:n, where n is an integer representing the number of active line electrodes, and said voltage generating means are arranged to decrease, during the passage to said at least second operating mode, the value of said activation voltage so as to compensate for the increase in the effective value of the signal present at the terminals of a non-active pixel, allowing a reduction of the refreshing frequency and a reduction of the activation voltage.

6. The device according to claim 5, wherein said voltage generating means are arranged to generate the ground voltage, the activation voltage and first, second, third and fourth non-activation voltages, said line signals vary, during a first half-cycle, between said ground voltage and said first non-activation voltage and, during a following half-cycle, between said activation voltage and said second non-activation voltage, said column signals vary, during the first half-cycle, between said activation voltage and a third non-activation voltage, and, during the following half-cycle, between said ground voltage and said fourth non-activation voltage, said line non-activation signals are brought, during the entire duration of said first half-cycle, to said first non-activation voltage, and, during the entire duration of said following half-cycle, to said second non-activation voltage, said activation and non-activation voltages being chosen such that, over a period of two successive half-cycles, the mean value of the signal present at the terminals of each pixel is substantially zero.

7. The device according to claim 5, wherein said non-activation voltages are determined, for each operating mode, so as to maximise the display contrast.

8. The device according to claim 5, wherein said non-activation voltages are determined such that the display contrast remains substantially constant during the passage from the first to said at least second operating mode.

9. The device according to claim 5, wherein said frequency generating means include:

an oscillator;

a frequency divider circuit connected to said oscillator and delivering a first multiplexing signal having a frequency determining said first multiplex rate and at least a second multiplexing signal having a frequency determining said second multiplex rate; and a frequency switch connected to said frequency divider circuit and controlled by said mode switching means so as to deliver said first or second multiplexing signal during respectively said first operating mode or said at least second operating mode.

10. The device according to claim 5, wherein said means for generating line signals include a programmable sequencer receiving said multiplexing signal and a line signal generator receiving said line activation and non-activation voltages, said programmable sequencer controlling the switching, in said line signal generator, between said activation and non-activation voltages.

11. The method according to claim 1, wherein said non-activation voltages are determined such that the display contrast remains substantially constant during the passage from the first to said at least second operating mode.

* * * * *